US006707432B2

(12) United States Patent
Strickland

(10) Patent No.: US 6,707,432 B2
(45) Date of Patent: Mar. 16, 2004

(54) POLARIZATION CONTROL OF PARABOLIC ANTENNAS

(75) Inventor: Peter C. Strickland, Ottawa (CA)

(73) Assignee: EMS Technologies Canada Ltd., Ottawa (CA)

( * ) Notice: Subject to any disclaimer, the term of this patent is extended or adjusted under 35 U.S.C. 154(b) by 0 days.

(21) Appl. No.: 10/024,228

(22) Filed: Dec. 21, 2001

(65) Prior Publication Data

US 2002/0113749 A1 Aug. 22, 2002

Related U.S. Application Data

(60) Provisional application No. 60/256,937, filed on Dec. 21, 2000.

(51) Int. Cl.[7] ..... H01Q 3/12
(52) U.S. Cl. ..... 343/761; 343/757; 343/781 CA
(58) Field of Search ..... 343/761, 766, 343/757, 779, 781 P, 781 CA, 839

(56) References Cited

U.S. PATENT DOCUMENTS 3,045,237 A 7/1962 Marston
3,916,415 A * 10/1975 Howrey ..... 343/754
4,574,289 A * 3/1986 Henderson ..... 343/786
4,786,912 A * 11/1988 Brown et al. ..... 343/761
5,579,018 A * 11/1996 Francis et al. ..... 343/757
5,874,925 A * 2/1999 Choi ..... 343/840
5,929,819 A 7/1999 Grinberg
5,966,104 A 10/1999 Massey et al.
6,031,502 A * 2/2000 Ramanujam et al. ..... 343/761
6,043,788 A * 3/2000 Seavey ..... 343/781 CA
6,188,367 B1 * 2/2001 Morrison et al. ..... 343/765
6,204,822 B1 * 3/2001 Cardiasmenos et al. .... 343/761
6,204,823 B1 3/2001 Spano et al.
6,313,805 B1 11/2001 Nishiyama

* cited by examiner

*Primary Examiner*—Don Wong
*Assistant Examiner*—Shih-Chao Chen
(74) *Attorney, Agent, or Firm*—Shapiro Cohen; Dennis R. Haszko; Robert A. Wilkes

(57) ABSTRACT

Systems and devices for mechanically rotating the polarisation of a signal emanating from or being received by an antenna system. The rotation of the polarisation is achieved by mechanically rotating the feed using a non-metallic drive cord or belt connected to a motor which is displaced outside or behind the radiating aperture. For a linear array of multiple antenna elements, each feed for each antenna element is rotated simultaneously and by an equal amount through the use of a drive system common to all the feeds. The drive system is coupled to each feed and to a drive motor. When the motor is activated, the drive system simultaneously rotates each feed by a given amount. By rotating the feed, the polarisation of the signal is correspondingly rotated and compensation for polarisation loss is provided.

9 Claims, 2 Drawing Sheets

POLARIZATION CONTROL OF PARABOLIC ANTENNAS

This application relates to U.S. Provisional Patent Application No. 60/256,937 filed Dec. 21, 2000.

FIELD OF INVENTION

The present invention relates to antenna systems and, more particularly, to devices for mechanically changing the polarisation of such antenna systems.

BACKGROUND TO THE INVENTION

The revolution in telecommunications in the past decade has led to numerous developments in all fields of communications and data processing. It has also led to a corresponding increase in not only data traffic but also in the need for individuals to be constantly in communication with their colleagues. Such a need has been so pervasive that even while individuals are in transit, such as when travelling by air, data communications with their office computers, staff, and colleagues is vital.

To meet the above need for such communications, onboard data communications systems for aircraft have been developed. Such systems include antenna subsystems that track and communicate with satellites that relay data signals from the aircraft to the ground. Such data signals are ideally transmitted to the satellites with as little loss as possible to maintain the integrity of the signal. One source of signal degradation is polarisation loss. When an antenna receives linear polarisation from a satellite, the local polarisation in the coordinates of the antenna is dependent on the location of the antenna relative to the satellite as well as the orientation of the antenna relative to the satellite. If the antenna is mounted on an aircraft, then the position and orientation of the antenna will vary as the aircraft moves. This motion requires that the polarisation of the antenna also varies with time to ensure that polarisation loss is minimized.

While polarisation synthesis techniques may be used to compensate for the polarisation loss, in order to use such techniques it is necessary to have two orthogonal polarisation components excited in the antenna feed at each frequency of interest. This precludes the implementation of systems where the feed has only inputs that correspond to a single polarisation in each ban of interest.

Other polarisation synthesis techniques require more complexity and, hence, added cost. These complex implementations use two polarisation components in each band of interest. It is noted that some systems may have a single broadband feed channel in each of the two polarisation components. However, for full-duplex operation, each of the channels would have to be split into transmit and receive paths after the feed, resulting in a complex system having four polarisation/frequency ports.

Another possible solution to the polarisation loss problem is the use of ferrite devices for Faraday rotation of the electrical fields. Ferrite devices are attractive for polarisation control where they can be used. Unfortunately, such devices suffer from narrow bandwidth and high loss, making them unsuitable for simultaneous operation at 12 GHz and 14 GHz and also resulting in high noise temperature and reduced EIRP (Effective Isotropic Radiated Power) for a given input power.

Based on the above, there is a need for a low-cost and simple solution for compensating for polarisation loss.

SUMMARY OF THE INVENTION

The present invention seeks to overcome the above problems by providing systems and devices for rotating the polarisation of a signal emanating from or being received by an antenna system through mechanical means. The rotation of the polarisation is achieved, as in the prior art, by mechanically rotating the feed receiving or transmitting the signal. A non-metallic drive cord or belt is used to transfer motion from a motor located outside or behind the aperture to the feed polarisation axis. For a linear array of multiple antenna elements, each feed for each antenna element is rotated simultaneously and by an equal amount through the use of a drive system common to all the feeds. The drive system is coupled to each feed and to a drive motor. When the motor is activated, the drive system simultaneously rotates each feed by a given amount. By rotating the feed, the polarisation of the signal is correspondingly rotated and compensation for polarisation loss is provided.

In one aspect the present invention provides, an antenna element including:

a reflective element having a reflecting surface;

a feed rotatable about an axis;

rotating means for rotating the feed about the axis, the rotating means being coupled to the feed, wherein the reflecting surface faces the feed and rotation of the feed changes a polarisation signal emanating from the antenna element or being received by the antenna element.

In a second aspect the present invention provides an antenna element including:

a reflective element having a reflecting surface;

a non-metallic drive cord or belt;

a feed rotatable about an axis;

a drive motor located outside or behind the radiating aperture;

wherein the reflecting surface faces the feed and rotation of the feed changes a polarisation signal emanating from the antenna element or being received by the antenna element, and rotation of the motor shaft moves the drive cord or belt causing the feed to rotate.

In a third aspect the present invention provides an array of at least two antenna elements, each antenna element including:

a reflective element having a reflecting surface;

a feed rotatable about an axis; the array including a common rotating means for rotating each feed of each antenna element, the common rotating means being coupled to each feed, wherein each reflecting surface faces a corresponding feed and activation of the common rotating means rotates each feed simultaneously.

an antenna element including:

a reflective element having a reflecting surface;

a feed rotatable about an axis;

a non-metallic cord or belt for rotating the feed about the axis, the rotating means being coupled to the feed, a drive motor located outside or behind the radiating aperture and connected to the cord or belt, wherein the reflecting surface faces the feed and rotation of the feed changes a polarisation signal emanating from the antenna element or being received by the antenna element.

BRIEF DESCRIPTION OF THE DRAWINGS

A better understanding of the invention may be obtained by reading the detailed description of the invention below, in conjunction with the following drawings, in which.

DETAILED DESCRIPTION

Figure 1:
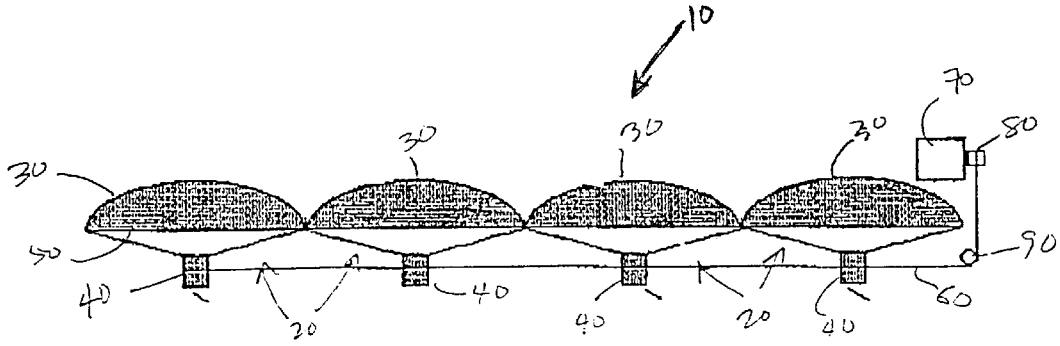
FIG. 1 is a side view of a linear antenna array illustrating an embodiment of the present invention.

Referring to FIG. 1, a linear array 10 of antenna elements 20 is illustrated. As can be seen from FIG. 1, each antenna element 20 has a reflective element 30 and a feed 40. Each reflecting element has a reflective surface 50 that faces the feed 40. Each feed 40 is coupled to a non-metallic drive cord or belt 60 and the drive cord or belt 60 is in turn coupled to a motor 70.

Upon activation of the drive motor 70, the drive cord or belt 60 is correspondingly activated and thereby simultaneously rotating each feed 40 by the same amount. In one embodiment, the rotational motion of the shaft 80 of the motor 70 is translated into linear motion by the drive means 60 through a capstan 90.

Figure 2:
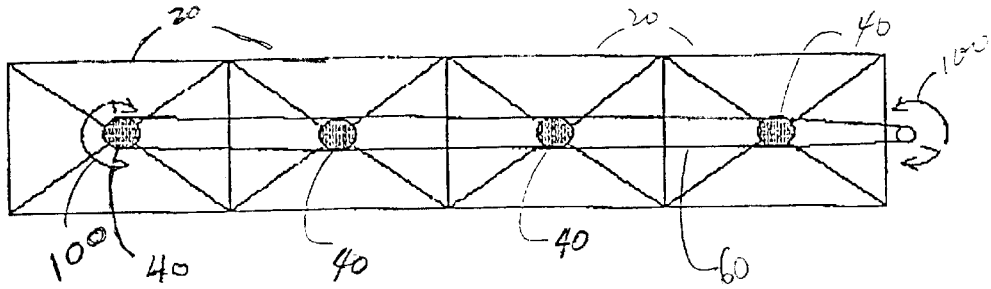
FIG. 2 is a top plan view of the linear antenna array of FIG. 1 illustrating the rotational motion of the feeds that is caused by the linear motion of the drive means.

Referring to FIG. 2, a top plan view of the linear array 10 is illustrated. As can be seen, each of the feeds 40 is free to spin on its axis through the use of the drive cord or belt 60. As can also be seen in FIG. 2, the rotation of the feeds 40 can be clockwise of anti-clockwise as shown by the arrows 100. As can also be seen in FIG. 2, the amount of rotation for each feed 40 is substantially equal among all the feeds. This is accomplished by having the drive cord or belt 60 being coupled and arranged to each feed similarly. Thus, a rotation of 10 degrees clockwise for a first antenna feed will be duplicated for all the other antenna feeds.

It should be noted that each of the antenna elements 20 are each independently excited by its own feed. Each of the feeds provide a transition between a guided wave on a coaxial wave guide or other transmission line to a wave propagating unguided through space. This unguided wave reflects off of the reflecting surface of the antenna element 20. The coupling of the rotatable feed 40 to a signal source or to a receiver is accomplished through well known means.

Regarding the drive cord or belt 60, the drive cord or belt 60 take the form of a drive cord that is wrapped around a feed pulley such that linear motion of the cord causes each of the feed pullies and thereby each of the feeds linear motion of the cord in one direction causes clockwise rotation of each of the feeds while linear motion of the cord in the other direction causes each of the feeds to rotate in an anti-clockwise direction. It should be quite clear that each of the feeds is mounted on a pulley that allows the feed to rotate when the pulley rotates. While the above description contemplates using a drive cord as the drive means 60, other implementations may be used. As an example a cable or a string may take the place of the drive cord as in a similar arrangement as explained above. The cable or string may be wrapped around the feed pulley such that linear motion of the cable or string causes rotational motion of the pulley and thereby, the feed.

Regarding the capstan 90 and the motor 70, the drive means 60 is coupled to the shaft 80 of the drive means in conjunction with the capstan 90. As noted above, the rotation of the drive shaft 80 causes linear motion of the drive means 60. This is accomplished by either looping or wrapping the drive means 60 around the shaft 80. If the motor 70 is placed in a position such that the shaft 80 is substantially parallel to the feeds 40, then the capstan 90 may not be required. In such an embodiment, the rotation of the shaft 80 directly translates into rotation into each of the feeds 40.

Regarding the reflective element 30, as noted above this reflective element 30 has a reflecting surface that faces the feed 40. The reflective element 30 has been found to be most effective when it takes the form of a parabolic. As a parabolic, the concave inner surface of the parabolic serves as the reflecting surface 50 for the reflective element 30. With the reflecting surface 50 facing the feed 40, a plain wave incident on the mouth of the parabolic is thereby focussed onto the feed. As can also be seen in FIGS. 1 and 2, the adjacent edges of the parabolics forming the different reflective elements 30 are parallel and that a mouth of each parabolic in nominally rectangular in shape.

Figure 3:
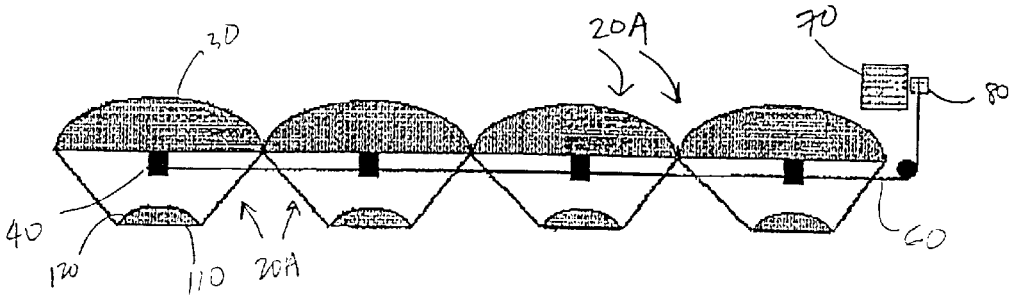
FIG. 3 is a side view of a linear antenna array similar to that in FIG. 1 but with the use of a sub-reflector.

Referring to FIG. 3, a second embodiment of the linear array is illustrated. As can be seen the structure for each antenna element 20A in FIG. 3 is similar to the structure of the each antenna element 20 in FIG. 1. The main difference between the two structures is the presence of a sub-reflector 110 for the antenna element 20A. The useful surface of the sub-reflector 110 either the concave or convex side depending on other design details. The sub-reflector 110 is placed such that feed 40 is between the reflective element 30 and the sub-reflector 110. Also, the reflector is placed such that it faces the reflecting surface of the reflective element 30. The drive means for the embodiment illustrated in FIG. 3 is similar to that explained above and illustrated in FIG. 1. The use of the sub-reflector 110 in the antenna element 20A allows the energy from the feed to be reflected off the sub-reflector prior to being reflected off of the primary reflecting surface 50 of the reflective element 30.

While the above designs illustrate systems where the input of the feed 40 is also the access for the reflective element 30 and the sub-reflector 110, this need not be the case. Other designs where the feed 40 does not share a common access with a reflector surface, either the reflector 120 or the reflective surface 50 of the reflective element 30 is possible. As another alternative, feeds 40 need not be rotated merely by means of a cord and pulley system. If the feeds or its pullies were equipped with outwardly extending teeth, a chain drive system could be implemented in place of the cord or belt drive system illustrated and explained above. It is important however that the drive be non-metallic in order that it does not alter the radiation pattern of the antenna system.

Figure 4:
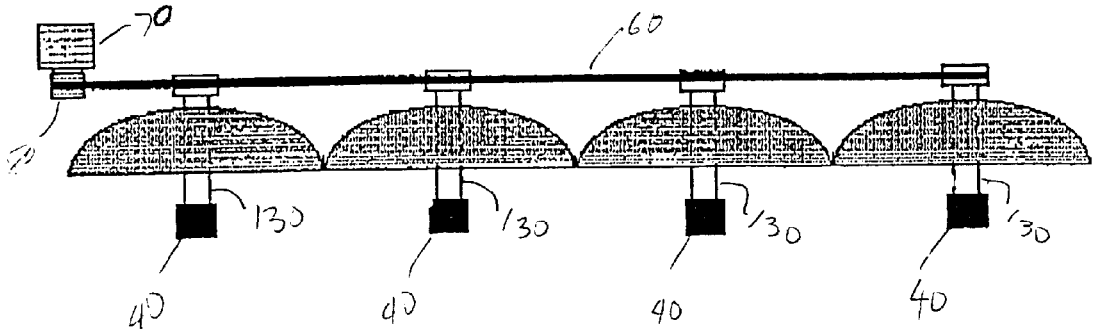
FIG. 4 is side view of a linear antenna array using a different drive arrangement to that illustrated in FIG. 1.

Referring to FIG. 4, an alternative drive arrangement for the invention is illustrated. For this embodiment, the feeds 40 are supported by dielectric support tubes 130. The feeds 40 are rotated by rotating the dielectric support tubes 130. The dielectric support tubes 130 are coupled to the drive means 60 and thereby tot he drive motor 70 in an arrangement similar to that explained above. The arrangement in FIG. 4 avoids the need for a bearing ring around the feeds. Such a bearing ring could block some the antenna radiation thereby reducing the achieved gain and possibly distorting the shape of the radiation pattern for the antenna array. Furthermore, as explained above the shaft 80 of the motor 70 in the embodiment illustrated in FIG. 4 is substantially parallel to the access of the feeds 40 and this arrangement allows for the dispensing of the capstan 90. Such an arrangement is thereby simpler and may provide better performance for the antenna system.

While the embodiments illustrated and explained above contemplate an antenna array, it is also possible to use a single antenna element using the mechanically rotated feed is illustrated and explained above. While the single antenna element may not provide the performance and the results of a complete linear antenna array, other applications may be suited for such a single antenna element.

What is claimed is:

1. An antenna element including:

a reflective element having a reflecting surface;

a non-metallic drive cord or belt;

a feed rotatable about an axis;

a drive motor located outside or behind the radiating aperture;

wherein the reflecting surface faces the feed and rotation of the feed changes a polarisation signal emanating from the antenna element or being received by the antenna element, and rotation of the motor shaft moves the drive cord or belt causing the feed to rotate; and wherein the antenna element is adjacent to other further antenna elements, and a common drive cord or belt is used to rotate each feed.

2. An array of at least two antenna elements, each antenna element including:

a reflective element having a reflecting surface;

a feed rotatable about an axis;

the array including a common rotating means for rotating each feed of each antenna element, the common rotating means being coupled to each feed, wherein each reflecting surface faces a corresponding feed and activation of the common rotating means rotates each feed simultaneously.

3. The array as in claim 2 wherein each reflecting surface is concave.

4. The array main claim 3 wherein each reflective element is parabolic in shape.

5. The array as in claim 2 wherein each antenna element further includes a sub-reflector having a reflector, the feed being placed between the sub-reflector and the reflective element and the reflector aces the reflecting surface.

6. The array as in claim 2 wherein the common rotating means includes a drive motor and a drive mean; the drive means being coupled to the drive motor and to each feed such that activation of the motor rotates each feed.

7. The array as in claim 6 wherein each feed is mounted on a pulley.

8. The array as in claim 7 wherein the drive means is a drive cord wrapped around each pulley.

9. The array as in claim 7 wherein the drive means is a chain and each pulley has outwardly extending teeth for engaging the chain.

* * * * *